US010985851B2

(12) United States Patent
Werbrouck

(10) Patent No.: US 10,985,851 B2
(45) Date of Patent: Apr. 20, 2021

(54) METHOD AND DEVICE FOR OPTIMIZING THE RADIOFREQUENCY POWER OF AN FM RADIOBROADCASTING TRANSMITTER

(71) Applicant: WORLDCAST SYSTEMS, Merignac (FR)

(72) Inventor: Daniel Werbrouck, Merignac (FR)

(73) Assignee: WORLDCAST SYSTEMS

( * ) Notice: Subject to any disclaimer, the term of this patent is extended or adjusted under 35 U.S.C. 154(b) by 0 days.

(21) Appl. No.: 16/343,468

(22) PCT Filed: Oct. 19, 2017

(86) PCT No.: PCT/FR2017/052874
§ 371 (c)(1),
(2) Date: Apr. 19, 2019

(87) PCT Pub. No.: WO2018/073542
PCT Pub. Date: Apr. 26, 2018

(65) Prior Publication Data

US 2019/0296842 A1 Sep. 26, 2019

(30) Foreign Application Priority Data

Oct. 21, 2016 (FR) ..... 1660222

(51) Int. Cl.
*H04H 20/42* (2008.01)
*H04H 20/44* (2008.01)

(52) U.S. Cl.
CPC ..... *H04H 20/423* (2013.01); *H04H 20/44* (2013.01); *H04H 2201/183* (2013.01)

(58) Field of Classification Search
None
See application file for complete search history.

(56) References Cited

U.S. PATENT DOCUMENTS 4,942,607 A * 7/1990 Schroder ..... H04B 1/665 704/203
5,129,098 A * 7/1992 McGirr ..... H03G 3/3042 455/126

(Continued)

FOREIGN PATENT DOCUMENTS

EP 3070842 9/2016

OTHER PUBLICATIONS

International Search Report dated Jan. 16, 2018 for International Application No. PCT/FR2017/052874.

*Primary Examiner* — Brian S Roberts
(74) *Attorney, Agent, or Firm* — Perman & Green, LLP

(57) ABSTRACT

A method for optimising the transmission power of an FM radio broadcasting transmitter includes
sampling a signal representative of the audio content to be broadcasted by the FM radio broadcasting transmitter;
continuously calculating the constituent parameters of the representative signal from frequency, amplitude, dynamic range, temporal distribution, energy and power;
continuously analysing the parameters by comparison with a model of psycho-acoustic data;
generating a controlling signal for controlling the power of the transmitter as a function of the results of the analysis and of the calculations allowed by the constituent parameters and the continuous psycho-acoustic data;
driving of the RF power of the transmitter by means of the controlling signal.
A device for implementing the method in an FM radio broadcasting transmitter is also proposed.

19 Claims, 8 Drawing Sheets

(56) References Cited

U.S. PATENT DOCUMENTS

| | | | | |
|---|---|---|---|---|
| 5,452,473 | A * | 9/1995 | Weiland | H04W 52/06 455/88 |
| 5,625,322 | A | 4/1997 | Gourgue et al. | |
| 6,651,041 | B1 * | 11/2003 | Juric | G10L 25/69 704/228 |
| 6,751,448 | B1 * | 6/2004 | Frydman | H03G 3/3047 455/126 |
| 7,161,426 | B2 * | 1/2007 | Hu | H03G 1/0088 330/129 |
| 8,195,094 | B1 * | 6/2012 | Briskman | H04B 1/034 455/42 |
| 2002/0180521 | A1 * | 12/2002 | Taylor | H03G 3/3042 330/129 |
| 2002/0183034 | A1 * | 12/2002 | Fayyaz | H04B 1/30 455/324 |
| 2006/0006940 | A1 * | 1/2006 | Hu | H03G 3/3042 330/129 |
| 2007/0026812 | A1 * | 2/2007 | Hu | H03G 3/3042 455/69 |

* cited by examiner

METHOD AND DEVICE FOR OPTIMIZING THE RADIOFREQUENCY POWER OF AN FM RADIOBROADCASTING TRANSMITTER

CROSS REFERENCE TO RELATED APPLICATIONS

This application is the National Stage of International Application No. PCT/FR2017/052874, having an International Filing Date of 19 Oct. 2017, which designated the United States of America, and which International Application was published under PCT Article 21(2) as WO Publication No. 2018/073542 A1, which claims priority from and the benefit of French Patent Application No. 1660222, filed on 21 Oct. 2016, the disclosures of which are incorporated herein by reference in their entireties.

BACKGROUND

1. Field

This present disclosure relates to optimisation of RF power of FM radio broadcasting transmitters and discloses a method and a device for management of this RF power as a function of the content of the modulating signal, so as to reduce the electrical power consumed by the transmitter and/or to optimise the radio service zone covered by the transmitter. At the present time, radio broadcasting in FM (Frequency Modulation), band II, is one of the few standards adopted around the entire planet, with a few variants.

2. Brief Description of Related Developments

The base of transmission standards for an FM sound radio broadcast program was announced during the 1950/1960 decade.

At the present time, the International Telecommunications Union-Radiocommunications (ITU-R) is the organisation that guarantees the definition and changes in technical rules. One of the recommendations is to fix a minimum RF field required for nominal listening comfort, for 3 types of reception areas (rural, urban and dense urban) and two broadcast modes (monophony, stereophony).

In the last 50 years, a change in the technology has enabled a very significant improvement to receiver performances, particularly to sensitivity and selectivity characteristics. At the present time, the observed gain in the sensitivity of an entry range FM receiver is estimated at 10 dB.

Moreover, the radio frequency (RF) stages benefit from active components enabling the use of an automatic gain control (AGC) with high amplitude before saturation; the signal to noise (S/N) ratio is also quasi-constant on the audio outputs of the receiver, up to the operating limit of the receiver.

There are also sound program processing tools composed of filters that "cut out" and process the spectrum of the audio signal in compression/expansion/dynamic range limitation. These audio and MPX processings drastically limit any transient variation of the sound signal above an absolute threshold and below an average threshold that can vary between about −30 dB to −6 dB from the absolute threshold.

This large reduction in the dynamic range considerably increases the mask effect by hiding noise specific to the receiver and enables an average increase of 14 dB in the signal to noise ratio at the receiver, without changing listening comfort for the listener (subjective measurements made in "blind" listening), On the other hand, the radiophonic environment of the FM band has degraded over the years: multiplication of radio broadcasting networks and therefore of occupancy of the channels, degradation of protection between adjacent channels due to compression tools, increased general radio frequency "noise" due to the appearance of GSM networks and polluting industrial equipment.

A very relative evaluation of the sum of these degradations is estimated as a loss in apparent sensitivity of about 10 dB (peak).

Therefore the sum of gains/losses due to changes in technologies, operation and the radio environment can be estimated at 10 dB+14 dB−10 dB=14 dB.

As a precaution, in view of some evaluations that cannot be precisely measured, this number is assumed to be 10 dB.

During the theoretical study of a network, these 10 dB constituting a bonus resulting in overquality are found to be particularly pointless in that they do not improve listening comfort in overlap zones in that the RDS system automatically manages the reception frequency benefiting from the best field conditions and/or S/N ratio.

Moreover, the calculation of the probability of interference, image frequencies, jamming and intermodulations, made before validation of a frequency plan is firstly one of the most sensitive points in practice and secondly a key to the success of a homogeneous, balanced network without any incompatibility in frequencies, provided that the calculated numbers are confirmed in the field.

In order to make the FM transmission networks, the FM transmitters are composed of different power blocks capable of supplying up to 10 kW RF, or more.

By definition in FM, modulation provokes a nominal frequency excursion and not a change in the RF power. This means that the output power remains perfectly stable, with or without a modulating sound signal.

The efficiency of a 10 kW transmitter is about 75%, namely a consumed electrical power of about 13.3 kW, 24 h/24 and 365 days per year. In addition to indirect consumption (forced ventilation of bays, air conditioning of rooms), the total consumption of an excellent FM transmitter with an RF output power of 10 kW can be evaluated at 15 kW.

Manufacturers make efforts to identify processes to optimise the efficiency of a transmitter by automated controls and adjustments such that each stage is located in its most favourable operating curve. Additional gains obtained hardly exceed 1 to 2%.

SUMMARY

This present disclosure is based on a combination of the two observations mentioned above:

Overquality is estimated to be about 10 dB in the link budget of an existing FM radio broadcasting network, in comparison with ITU-R recommendations, and station managers or broadcasting operators would like to make economies of scale in the operation of their equipment. The present disclosure aims to optimise the power of an FM transmitter by making a device that controls the RF output power of the transmitter as a function of the apparent audio signal-to-noise ratio predicted on reception of the signal.

The apparent signal-to-noise ratio can be defined as follows: it is the level of non-essential audible noise (everything that is not contained in the useful sound program) relative to the useful signal level (the sound program).

Perception of noise is based particularly on the mask effect by which as the denser the sound signal gets, the more it masks noise and sounds with lower amplitudes. In FM, due to the presence of audio processing tools, levels of density, energy, modulating signal power are reached that have never been found before in other fields of sound broadcasting. The dynamic range thus lies between two unchanging limits with amplitudes of a few decibels, the high threshold of which is always at the maximum allowable excursion. The mask effect is then maximal regarding non-essential and undesirable noise that could be included in the global signal demodulated by the receiver.

Moreover, the ear is also insensitive to sounds produced after disappearance of the masking sound, for durations varying between 50 and 100 ms, depending on the frequency and amplitude of masking and masked sounds. This post-masking effect is used in this case to make some of the calculations and to determine some of the actions to be carried out using the device according to the present disclosure.

More precisely, this present disclosure discloses a method for optimising the transmission power of an FM radio broadcasting transmitter that comprises the following steps:

sampling of a signal representative of the content to be broadcasted (modulating signal at the input of a modulator) of the FM radio broadcasting transmitter;

calculating constitutive parameters of said representative signal among the frequency, amplitude, dynamic range, temporal distribution, energy and power;

analysing said parameters in comparison with a model of psycho-acoustic data;

generating a signal controlling the power of the transmitter as a function of the results of the analysis and the calculations made possible with said constitutive parameters and said listening data in real time;

controlling the RF power of the transmitter using the controlling signal.

Consequently, the present disclosure discloses a method of optimising the transmitted radio frequency power, therefore directly the electrical power consumed by an FM radio broadcasting transmitter.

The present disclosure also discloses a device for implementing the method according to the present disclosure that comprises means for measurements of the amplifier output signal and a processing module comprising:

analogue/digital conversion means adapted to convert said measurements into digital data, means for storing digital data, calculation conditions and calculation values; calculation means, and means for generating electric signals to control servoing of the transmitter power by digital/analogue conversion.

Advantageously, the means for generating electric signals to control the transmitter power by digital/analogue conversion are connected to a stage controlling amplifier driver stages.

In addition or alternatively, the means for generating electric signals to control the transmitter power by digital/analogue conversion can be connected to the FM carrier generation stage and/or to a stage controlling amplifier power blocks and/or power supplies to these amplifier power blocks.

Other characteristics of the present disclosure will become clear after reading the appended claims and description.

BRIEF DESCRIPTION OF THE DRAWINGS

Other characteristics and advantages of the present disclosure will become clear after reading the following description of a non-limitative embodiment of the present disclosure, with reference to the drawings that represent.

DETAILED DESCRIPTION

Figure 1:
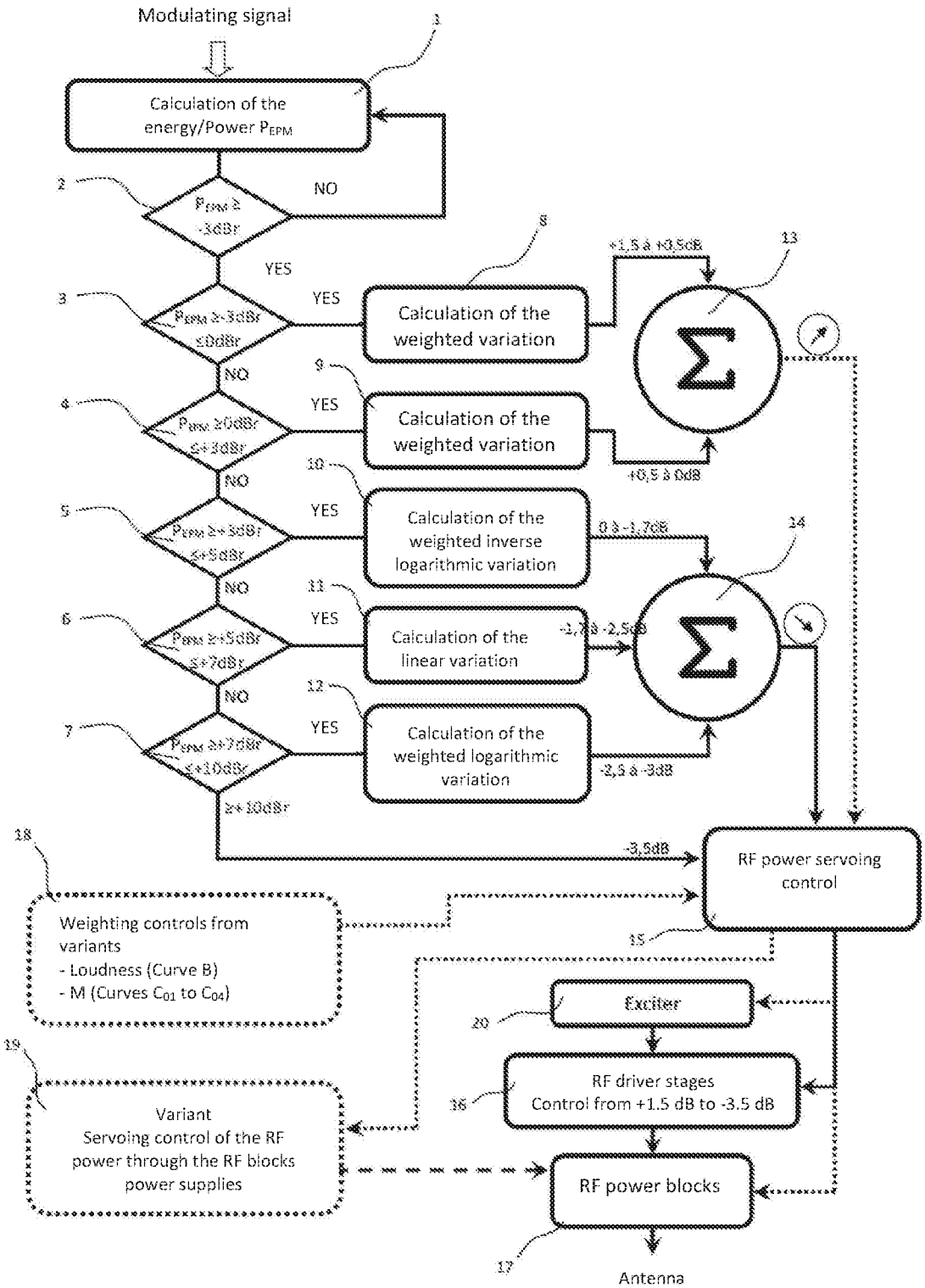
in FIG. 1: a flow chart representative of a method according to the present disclosure, in FIGS. 2 and 3: flow charts of methods according to particular embodiments.

The purpose of this present disclosure is to make a method and a device for controlling the RF output power of a transmitter as a function of the apparent audio signal-to-noise ratio, predicted on reception of the signal.

The apparent signal-to-noise ratio can be defined as being the audible non-essential noise level, in other words everything that is not contained in the useful sound program, relative to the useful signal level that is the sound program.

The perception of noise is based particularly on the mask effect, perfectly defined in the scientific literature dealing with psycho-acoustics and used in almost all digital compression systems with allowable losses of audio data, and particularly the ATRAC system developed by SONY, then the different versions of the MP3 standard.

Overall, the denser the sound signal gets, the more it masks noise and sounds with lower amplitudes. In FM, due to the presence of audio processing tools, density levels of the Multiplex modulating signal (stereophonic composite signal compatible with monophonic receivers and associated signals of sub-carriers and data associated with the program) are reached that have never before been achieved in other fields of sound broadcasting. The dynamic range thus lies between two unchanging limits with amplitudes of a few decibels, the high threshold of which is always at the maximum allowable excursion. The mask effect is then maximal regarding non-essential and undesirable noise that could be included in the total signal demodulated by the receiver.

Moreover, the ear is also insensitive to sounds produced after disappearance of the masking sound, for durations varying between 50 and 100 ms, depending on the frequency and amplitude of masking and masked sounds. This present disclosure uses this post-masking effect to make calculations and to determine actions to be taken through the controlling device according to the present disclosure.

In summary and overall, the present disclosure uses non-linear acoustic characteristics of the human auditory system, particularly the general mask effect observed in the audible frequency band and effects produced by sound processing systems used in FM transmission sets.

In the context of the present disclosure, several parameters and signals can be considered and the present disclosure may comprise an analysis of the modulating signal on criteria concerning frequency, amplitude, dynamic range, spectral distribution and calculation of instantaneous and average energy, power of sound signals forming the modulating signal such as the M signal, the S signal, the Pilot signal and optional ancillary signals making up the modulating signal such as sub-carrier(s), complementary stereophonic signals, etc.

The present disclosure will then comprise controlling of the transmitter RF power as a function of said analysis and said resulting calculations by means of a controlling signal.

Several parameters may be taken into account depending on the embodiment of the present disclosure:

Setup and disappearance times of masking sounds;

The energy/power level PEPM calculated after frequency and temporal analysis of the signal possibly modulating possibly:

The Loudness level of the modulating sound signal;

and the density of the left+right (M) signal of the multiplex signal.

The term Loudness for the purposes of the present disclosure is a term designating in the context of the present disclosure, the sound strength of the signal as used in standards and not the physiological correction filter comprising a curve modelling the sound intensity perceived by the human ear.

The present disclosure includes a series of algorithms that combine measurements derived from real time observation of one or several of these parameters to obtain a resultant signal representative of the apparent signal/noise ratio perceived by the listener.

This resultant signal is used to control the RF power of the transmitter, by acting either on the RF excitation control, or on the controls of RF amplifiers, or on the supply voltages of the power stages, or on a mix of two or three of these actions. This control of the transmitter RF output power then allows to obtain an apparent signal/noise ratio constant for the listener, regardless of the type of program.

When the calculations made on the sound program do not allow to obtain a sufficient apparent signal to noise ratio with the base power of the transmitter, the RF power of the transmitter is increased in the proportion calculated in the series of algorithms, to tend towards a constant apparent signal to noise ratio.

When the calculations made on the sound program indicate a sufficient signal-to-noise ratio, no control is applied and the transmitter output power remains at the maximum.

When the results of calculations made on the sound program give a ratio higher than the set apparent signal to noise ratio, the RF power of the transmitter is reduced in the ratio calculated in the series of algorithms, to tend towards a constant apparent signal to noise ratio which saves energy at the transmitter.

Over a representative observation period, for example 24 hours, the method can be used to manage an average RF power less than the maximum transmitter power, therefore a proportional reduction in the energy consumption of the transmission system, while improving the listening comfort during periods in which the signal/noise ratio is predicted as being potentially degraded.

Set values, called operating set values, can be used to fix the minimum and maximum powers bounds allowed by the operator in accordance with technical or regulatory recommendations.

The following operations are carried out to obtain the necessary signals and their preprocessing:

The modulating signal is sampled at the transmitter modulator input. It may be the total Multiplex (MPX) signal constituted of the L+R (M), L−R (S) channels of the sound signal, the stereophonic Pilot sub-carrier, 19 kHz as standardised, and all sub-carriers and associated data, mainly the RDS at 57 kHz. The sampled signal may also be a signal retransmitted through radio frequency, through digital audio or network (IP).

Various processing required by the station operator has already been made on this total modulating signal. Therefore it is the true reflection of the modulated signal broadcast by the transmitter.

Optionally, the electrical signal indicating the real RF output power of the transmitter is sampled, provided by the output probe measuring direct and reflected powers from the transmitter. This signal is the true reflection of the transmitter RF output power and:

a—either the transmitter output power setting or adjustment signal is derived. This signal is generally composed of a direct electric voltage controlling the RF driver stage, itself exciting the power blocks of the final stages put in parallel. This signal allows to adjust the output power to the nominal value, with a variation amplitude between +1.5 dB and −3.5 dB, or even more. Therefore the value of this control signal is the true reflection of the variation in the transmitter RF output power;

b, or the RF control signal is derived directly at the FM carrier generator (exciter). The value of this control signal is also the true reflection of the variation in the transmitter RF output power;

c, or the RF control signal is derived directly at the power blocks of the final stages put in parallel. The value of this control signal is also the true reflection of the variation in the transmitter RF output power;

d—or the control signal of the power supply(ies) of the transmitter RF power stages is derived. This signal allows to adjust the power supply voltage of the RF power stages and consequently, to adjust the gain of these stages, and therefore to modify the RF output power.

Or two or more of the actions described above are combined.

The device according to the present disclosure comprises means for processing the sampled and/or derived signals in the form of specific algorithms according to a particular methodology.

The energy/power of the modulating signal is calculated as follows:

A method of distribution of signals samples and/or a direct calculation is (are) taken into account, based on the sum of the squares of the samples. The result of these calculations is called PEPM and it is expressed in dB relative (dBr) with 0 dB=neutral result requiring no variation in the RF power of the transmitter.

The minimum duration d of a sample is determined, for example 10 to 100 ms and preferably about 50 ms. The level of each observation in a period n*d of 0.5 to 2 seconds, for example about 1 second, is totaled. PEPM is then calculated based on the principal of the sliding second by adding new samples with recurrence d. Therefore one PEPM result can be obtained every 50 ms, obtained on an average observation with a sliding duration of n*d, for example one second, except for the first n*d calculation period.

For subsequent calculations, it is assumed that the 0 dBr reference of PEPM corresponds to a permanent signal with frequency 1 kHz provoking a frequency excursion or deviation of ±19 kHz that is allowed and recommended by ITU-R in the calculation of the MPX power reference.

Data used to calculate the energy/power PEPM are collected together in a calculation system, for example a microprocessor or microcontroller and its program memory and associated data.

For example, for conditions for generation of the RF power controlling signal according to the present disclosure, the assumed energy/power range PEPM used is between −3 dBr and +10 dBr. In the example represented in FIG. 1 corresponding to the application case of efficiency levels between 2 and 4 PEPM and for a type B (generalist) program category, a step 1 is done to calculate the energy/power PEPM from the modulating signal. A first test 2 defines that the system is deactivated below a limit of −3 dBr.

Furthermore, the variation in the RF power is fixed at between −3.5 dB and +1.5 dB, for example. From 0 dB to −3.5 dB, it is a reduction in the RF power, and from 0 dB to +1.5 dB it is an increase in the RF power. Obviously, these values can be modified without going outside the context of the present disclosure.

A second test 3 defines that for PEPM equal to between −3 dBr and −0 dBr, a calculation 8 of the control of the RF power, in this case an increase, from +1.5 dB to +0.5 dB is possible. A third test 4 defines that for PEPM equal to between 0 dBr and +3 dBr, a calculation 9 of the control of the RF power, in this case still an increase, from +0.5 dB to 0 dB is possible.

The remaining part of the calculation used in the example is intended to make a first non-linear curve (Curve A) between the variation in the energy/power PEPM and the RF power.

This is done by determining the shape of the variation in the curve by additional tests on PEPM. A fourth test 5 defines that for PEPM equal to between +3 dBr and +5 dBr included, a weighted inverse logarithmic type calculation 10 of the variation of the control, in this case an attenuation, of the RF power is made;

A fifth test 6 defines that for a calculated PEPM equal to between +5 dBr and +7 dBr, a linear type calculation 11 of the variation of the control, in this case also an attenuation, of the RF power is performed;

A sixth test 7 defines that for a calculated PEPM equal to between +7 dBr and +10 dBr, a weighted logarithmic type calculation 12 of the variation of the control, still an attenuation, of the RF power is performed.

These data are also input into the calculation system.

The calculation limits are such that for PEPM=−3 dBr the RF control chosen is +1.5 dB (increase), and that for PEPM>+10 dBr, the RF control chosen is −3.5 dB (attenuation). Knowing that no increase nor attenuation of the RF power is applied for PEPM=0 dBr. The resultants of these calculations are summed for possible increases 13 and possible attenuations 14 and they supply data for generation of the driver stage control signal at a digital/analogue converter 15. This control signal drives control of the RF output power of the transmitter power stage via the driver stage 16 and/or the exciter 20 and/or the power blocks 17 and/or the power supply blocks 19.

In addition to using PEPM as the reference for the calculation of the control in increase/attenuation of the RF power, there are three possible variants for optimising the efficiency of the present disclosure and reducing possible secondary effects.

Figure 2:
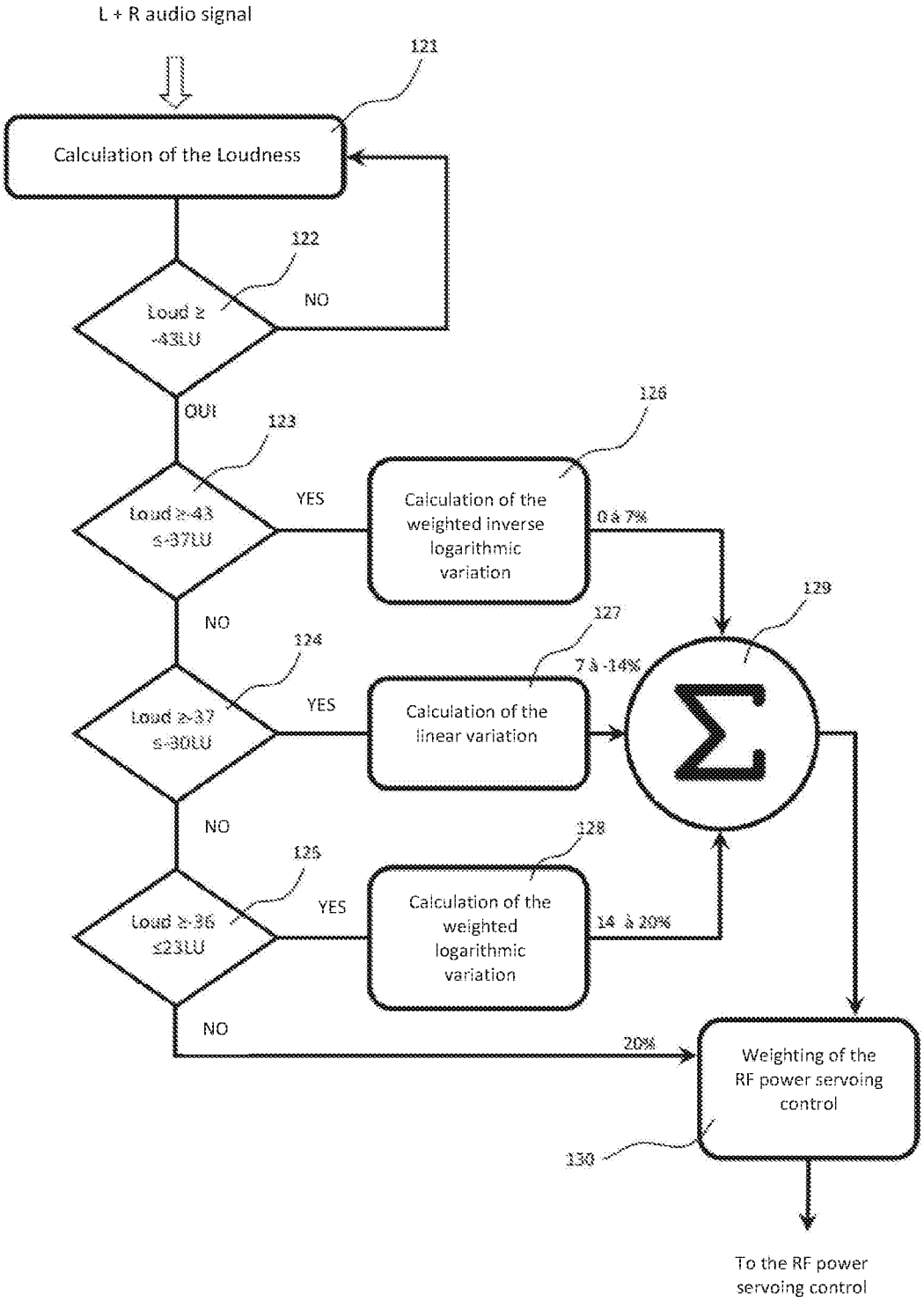

A first variant 18 shown in detail in FIG. 2 consists of taking account of the Loudness level, that results in a sound force, an estimated model representative of the sound energy as a function of the sound level and characteristics of the ear as defined in recommendation EBU-R128 and methodology ITU-R BS.1770-2 and its appendices.

The reference used is the Loudness level accepted in radio broadcasting, namely −23 LUFS (Loudness Unit Full Scale), with a Loudness Range equal to about 20 LU (Loudness Units, the unit of sound force).

Based on the same principle as that applied with the calculation of energy/power PEPM, a second non-linear curve (curve B) is established satisfying the same mathematical variation rules, but with Loudness data.

A first step 121 consists of a calculation of the Loudness level.

A first test 122 determines a maximum Loudness level of −43 LU beyond which no correction is made.

A second test 123 triggers a weighted and inverted logarithm type variation calculation 126 of the control of the RF power for a measured Loudness equal to between −43 LU and −37 LU, A third test 124 triggers a linear type variation calculation 127 of the control of the RF power for a measured Loudness equal to between −37 LU and −30 LU, A fourth test 125 triggers a weighted logarithm type variation calculation 128 of the control of the RF power for a measured Loudness equal to between −30 LU and −23 LU, The resultant of these calculations is combined in an adder 129 and produces curve B that forms in a digital/analogue converter 130 a weighting signal of the control curve A of a driver stage of the amplifier and control of the transmitter RF output power, with the following conditions:

For a measurement result of PEPM (curve A) at time T, a value of the Loudness measurement is calculated.

The value of the RF control in dB calculated using curve A, V1 is then weighted with the calculated value in % V2 of the weighting via curve B, The result of the operation can be used to obtain the weighted value V3 of the RF control to be made to the stages concerned using the theoretical formulation:

$$V3=V1-(V1*V2)$$

Figure 3:
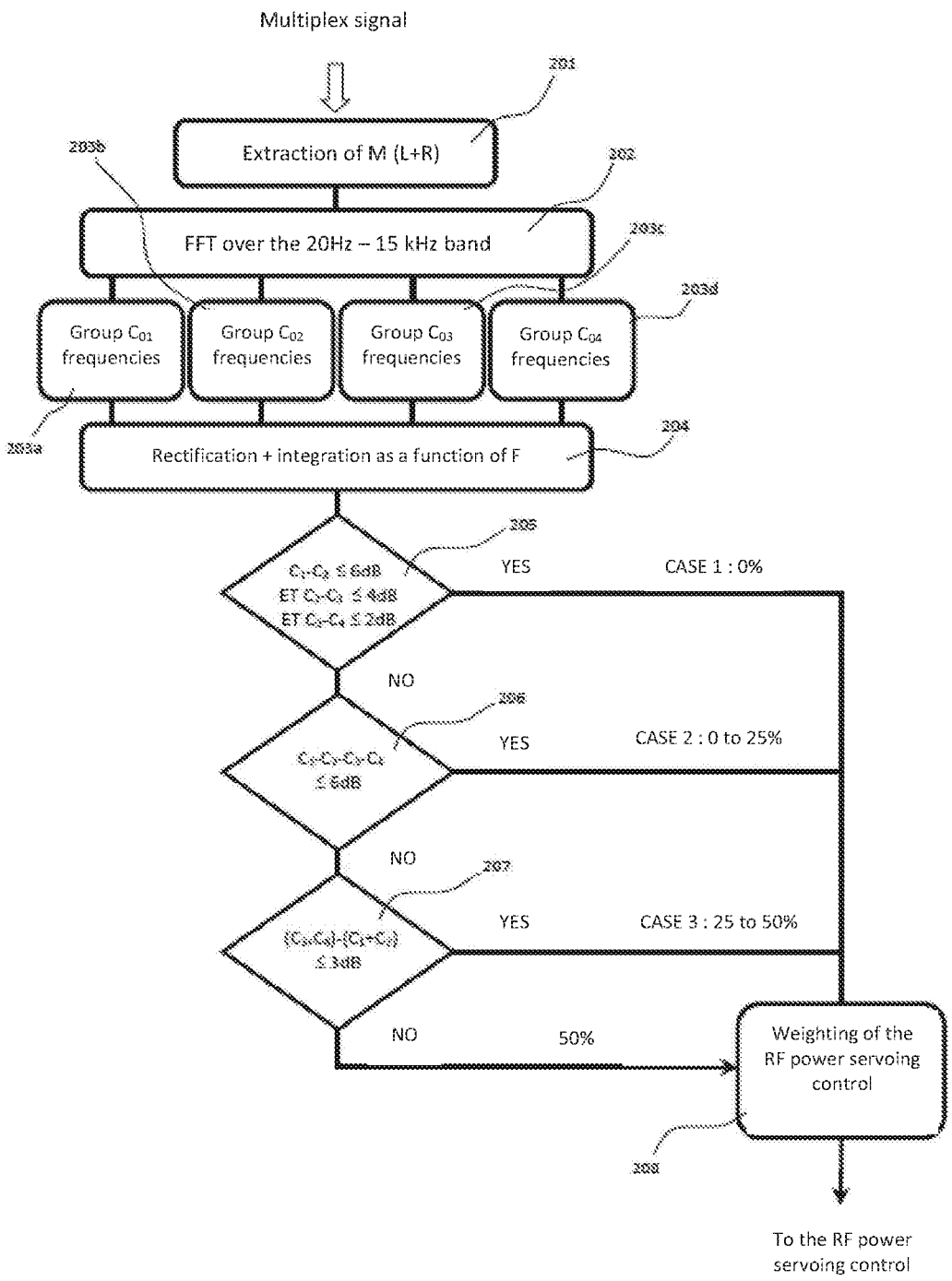
Figure 4:
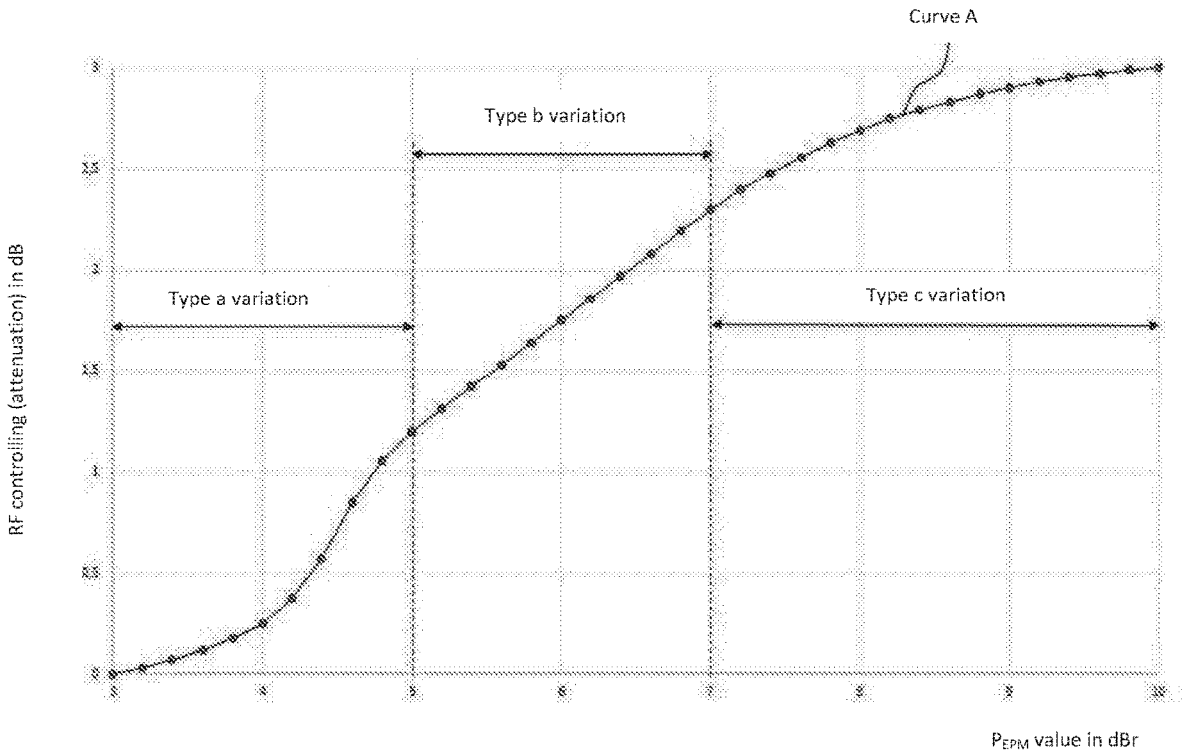
in FIGS. 4, 5, 6A, 6B and 6C: weighting curves for the method in FIG. 3.
Figure 5:
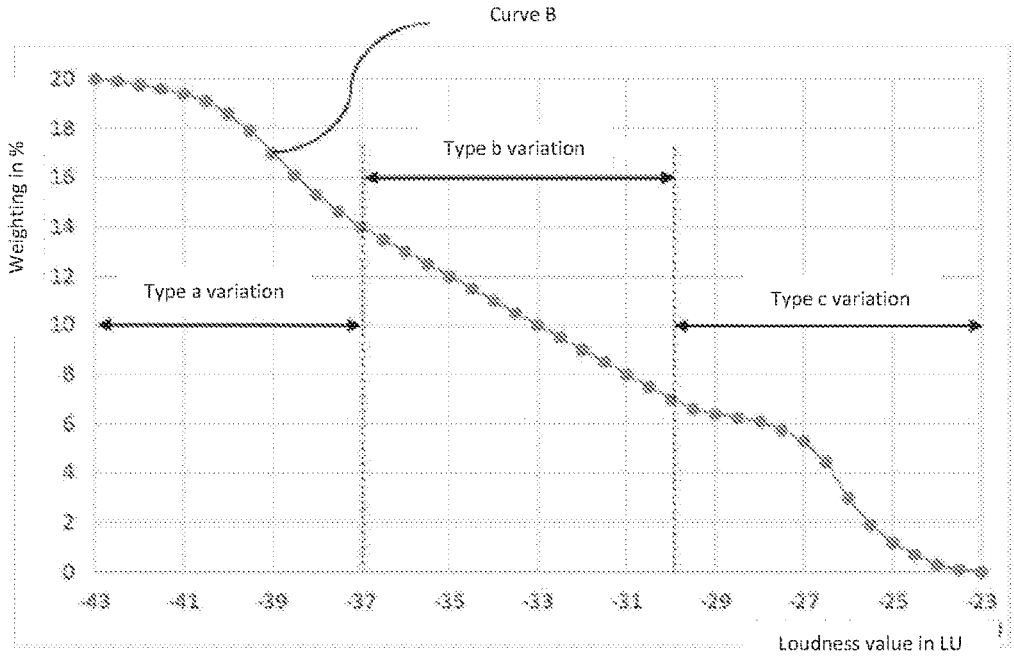

A second variant corresponding to FIG. 3 consists of taking account of the M signal, Left (L)+Right (R) sound component of the useful signal.

To achieve this, the signal M is extracted from the multiplex signal or the transport or retransmission network in step 201.

The signal is sampled to obtain the entire spectrum of signal M for example on the 20 Hz-15 kHz spectrum and then a Fourier transformation FFT 202 is made and four groups of frequencies 203*a*, 203*b*, 203*c*, 203*d* are defined. A calculation module 204 then rectifies the 2 alternations and the signal is integrated over a period of the order of about 50 ms to obtain a curve representative of the envelope of peaks of the signal M.

A series of curves (Curves C01 to C04) is established, identified under the general term curve C, of linear variation with the envelope of the signal M.

Secondly, with the same signal M extracted from the MPX, an FFT is done on the 40 Hz-15 kHz band. The principle being to make an evaluation of the value of the average instantaneous amplitude on frequency bands.

This is done by making a series of curves on frequency bands containing consecutive octaves, the integration time for the calculation of the amplitude envelope being greater than or equal to the inverse of the lowest frequency in the frequency band for each curve.

The curves are advantageously made by octave or by ⅓ of an octave. In the example given below, the curves are made on ranges of octaves.

A series of 3 or 4 curves is established, Curves C01 to C04 from the FFT by calculating the envelope of the amplitude for each octave and group of octaves as a function of T, for example with the same integration base as for the calculation of the envelope, but with weighting as a function of the corresponding series of octaves. The calculation is made following the distribution example given below for which variants remain possible and that considers a lower band frequency of 20 Hz and a significant signal power starting from about 40 Hz because of the high pass filter cutting off at 20 Hz and attenuating frequencies between 20 Hz and 40 Hz:

A curve C01 for the sum of the 40 Hz-80 Hz+80 Hz-160 Hz, or 20 Hz-40 Hz+40 Hz-80 Hz octaves depending on the type of program, with an integration time greater than or equal to 1/F01, where F01 is the lowest frequency in the frequency range used for this curve;

A curve C02 for the sum of the next two octaves, the 160 Hz-320 Hz+320 Hz-640 Hz, or 80 Hz-160 Hz+160 Hz-320 Hz octaves if the first curve is shifted downwards, with an integration time greater than or equal to 1/F02, where F02 is the lowest frequency in the frequency range used for this curve;

A curve C03 for the sum of the 640 Hz-1.28 kHz+1.28 kHz-2.56 kHz, or 320 Hz-640 Hz+640 Hz-1.28 kHz octaves for a lower curve shifted downwards, with an integration time greater than or equal to 1/F03, where F03 is the lowest frequency in the frequency range used for this curve;

A curve C04 if necessary for the sum of the 2.56 kHz-5.12 kHz+5.12 kHz-10.24 kHz, or 1.28 kHz-2.56 kHz+2.56 kHz-5.12 kHz+5.12 kHz-10.24 kHz octaves for a lower curve shifted downwards, with an integration time greater than or equal to 1/F04, where F04 is the lowest frequency in the frequency range used for this curve.

There is no need for curves to be created for higher frequencies considering the low power used for the high part of the spectrum.

Figure 6A:
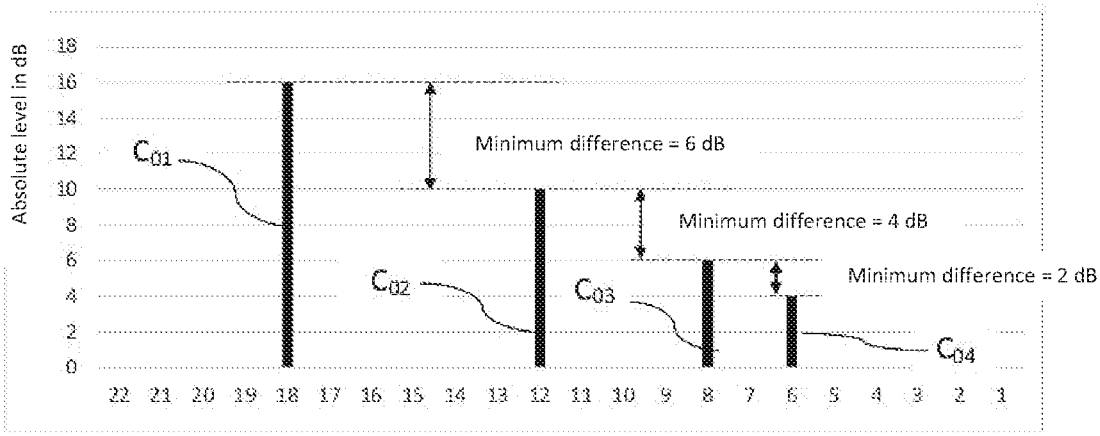
Figure 6B:
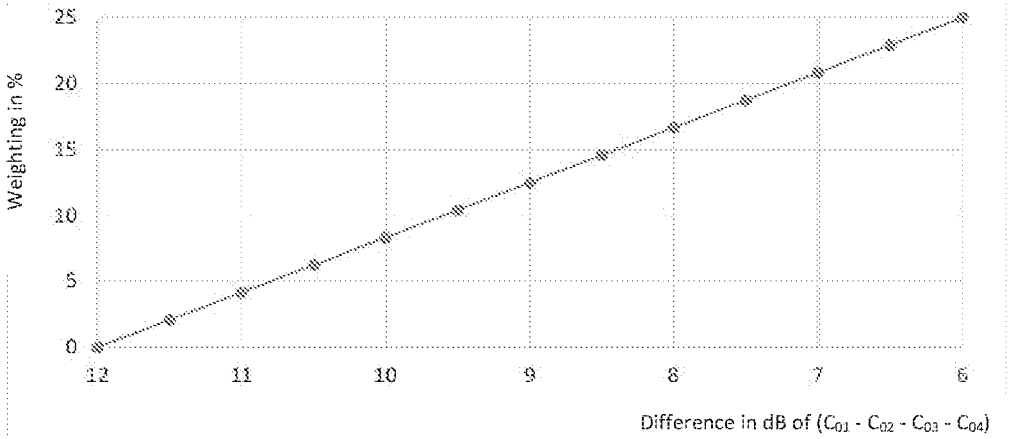
Figure 6C:
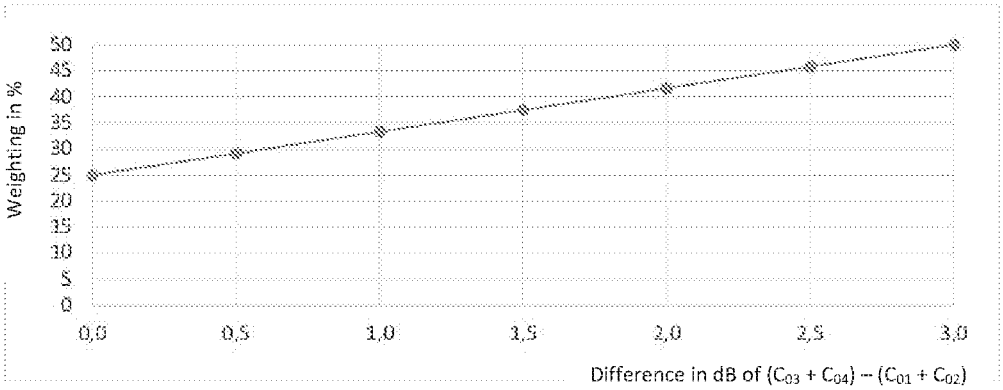

Test steps 205 to 207 then quantify the energy difference (density) between each envelope of each curve thus created for a same time unit corresponding to the inverse of the minimum frequency of the useful signal, namely in FM: 50 ms, and an algorithm to weight control of the RF power is established, in which:

No weighting if the amplitude of curve C01 is at least 6 dB higher than curve C02, itself at least 4 dB higher than curve C03, itself at least 2 dB higher than curve C04 as represented in FIG. 6A and in step 205 in FIG. 3;

Weighting of −5% to −25% of the control of the RF power if the difference in amplitude between curves C01 to C04 becomes smaller, with −25% if the total of the differences between C01 and C04 does not exceed 6 dB. Weighting is represented in FIG. 6B as a function of differences in dB between curves C01, C02, C03 and C04 which corresponds to test 206 in FIG. 3;

Maximum weighting, for example from −25% to −50%, of the control of the RF power, represented in FIG. 6C as a function of the differences in dB between curves C01, C02, C03 and C04, if the difference in amplitude between curves C01 and C04 shows that (C01+C02) is less than or equal to (C03+C04) in test 207 in FIG. 3. Weighting is −25% if the 2 curve groups are equal and is equal to −50% if (C01+C02) is −3 dB below (C03+C04).

Values obtained from tests are used in a module 208 giving a weighting control signal for the RF power servoing control.

At the output, control of the RF power obtained from curve A using data from curve C, is weighted with the following condition: in the case of a fast variation (<approx. 300 ms) of curve C towards 0, for example a variation of 6 dB/100 ms, the control ratio of the RF power is reduced. This ratio can be adjusted by parameter setting configurable by the operator, with a maximum of 50%.

However, fast variations, for example in less than 300 ms or 400 ms, of the increase in the envelope are ignored in weighting when the latter is less than 0.5 dB.

Complementary to this variant and depending on the operator's constraints, the use of a programmed broadcast delay can also be validated:

Latency times between sending a sound program and reproduction of this sound program in a receiver are nowadays accepted as a technological constraint. Regardless of whether they are due to signal propagation, for example about 240 ms for a satellite link, or calculation times for data compression equipment and for equipment encoding some codecs, from a few milliseconds to several seconds, therefore it is sometimes possible to delay broadcasting of a radio program.

In the case of the present disclosure, a programmed delay of the order of 250 ms would make it possible to predict the exact RF power control level and to act on the power adjustment control before the observation of the variation in the energy/power of the modulating signal. This would bring the action into phase at exactly the required instant and not after a delay of a few tens to a few hundreds of ms necessary for analysis of the situation and calculations necessary for decision making.

Even if the post-masking effect must be sufficient in the vast majority of cases, this programmed delay in broadcasting the sound content would definitively and naturally solve the question of the risk of an audible shift between analysis and action which would improve the performances of the method.

Signals calculated with and without the proposed variants are calibrated and adapted to elements of transmitter power adjustment controls, through the RF driver stage and/or the FM carrier generation stage (exciter) and/or control stages of power blocks and/or power supplies to RF power stages.

Implementation of the present disclosure does not require any structural modification to modern transmitters. All required signals and controls are easily accessible and are already used in standard management of an FM transmitter.

Therefore in order to benefit from the advantage of the present disclosure, the electrical signal sampling, calculation and electrical signal generation device should be inserted in the transmitter in the form of an additional module comprising a hardware acquisition and calculation platform, itself supporting the onboard software of the application comprising signal processing units and decision algorithms and actions concerning the control and servoing of the transmitter RF output power.

Figure 7:
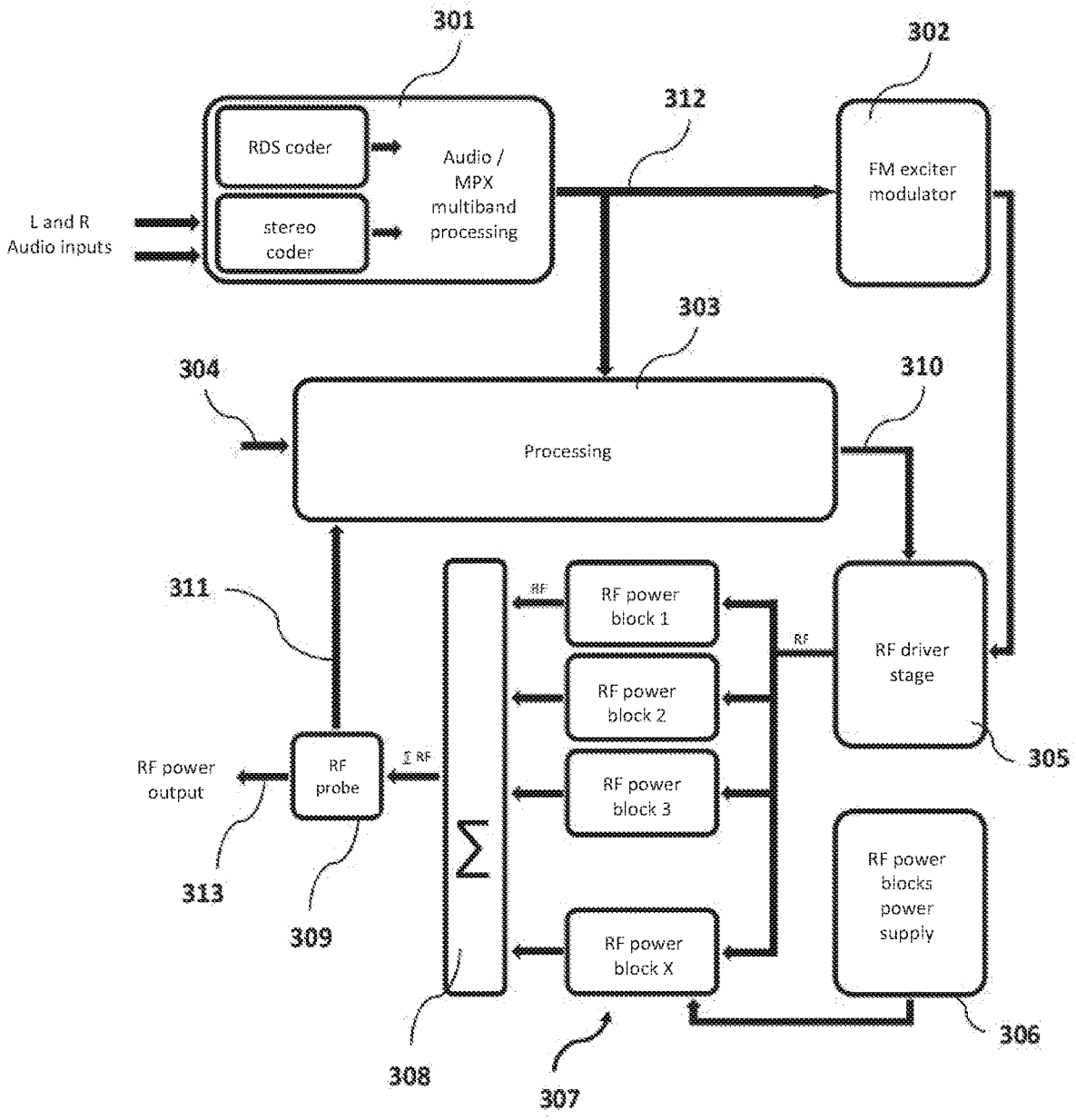
in FIG. 7: a block diagram of a device for implementing the method shown in FIG. 1.
Figure 8:
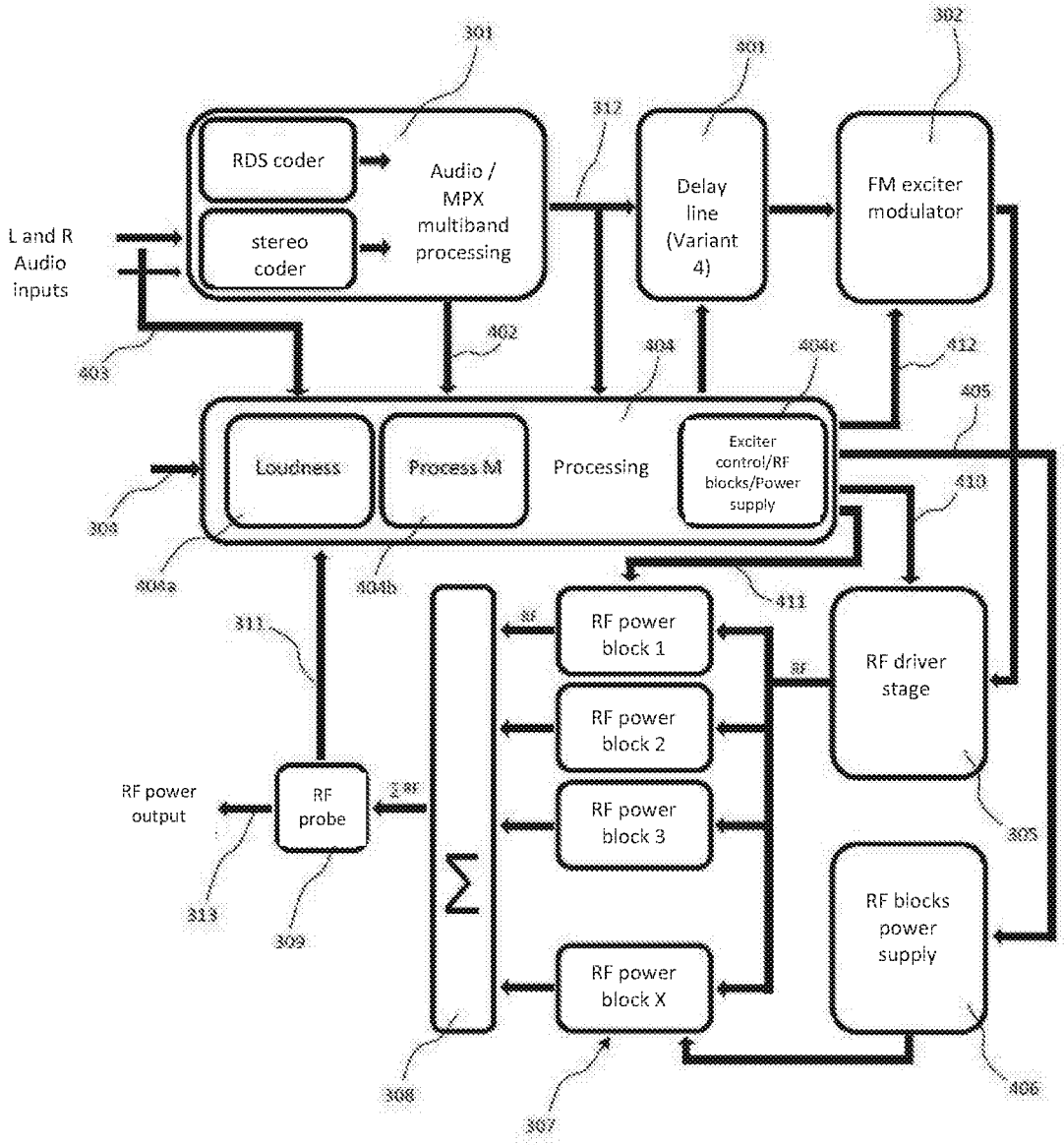
in FIG. 8: a block diagram showing variants of the device in FIG. 7.

FIGS. 7 and 8 represent block diagrams of FM transmitters equipped with modules according to the present disclosure and variants thereof.

FIG. 7 represents a block diagram of a transmitter including the present disclosure in the form of a processing module 303.

The transmitter comprises audio inputs supplying power to an audio processing block 301 comprising a stereo encoder, possibly an RDS encoder and multi-band audio processing. The signal output from the audio processing block is a multiplex signal 312 that is input into an FM modulator/exciter (carrier generator) 302 amplified by a driver stage 305 and RF power blocks 307 connected to a power supply 306 and the outputs whereof are added 308 to output an RF power output signal 313.

The processing module 303 receives a set value 304 in which correction parameters chosen by the operator are defined, including particularly correction ratios, application frequencies, preliminary settings as a function of the type of sound program, definition of minimum/maximum RF power limits, etc. It also receives the multiplex signal 312. The processing module makes the calculations necessary to generate a control signal 310 for driver stages 305.

FIG. 8 represents a variant for which the processing module 404 comprises additional corrections discussed above, the Loudness correction module 404*a*, the correction module 404*b* as a function of the audio signal 403 and module 404*c* adapted to driving control 410 of the driver stage 305, either additionally or alternately:

the exciter, in other words the FM carrier generator (302) through the control 412;

the power stages 307 through the control 411;

the power supply 406 of the power blocks 307 through a control signal 405;

commands output from the processing module 404 resulting from the combination of processings 404, 404*a*, 404*b*.

The transmitter comprises audio inputs supplying power to an audio processing block 301 comprising a stereo encoder, possibly an RDS encoder and multi-band audio processing. This audio signal can be input into the transmitter by other very different channels, for example audio wire, radio waves, satellite, analogue or digital mode, through computer networks (Intranet or Ethernet), through a retransmission receiver totally or partially demodulating the signal, etc. The signal output from the audio processing block is a multiplex signal 312 that is input into a modulator/exciter or FM carrier generator module 302. In this example, the multiplex signal 302 passes into a delay line module 401 driven by the processing module 404. The output signal of the FM modulator is amplified by a driver stage 305 and RF power blocks 307 connected to a power supply 406. Outputs from power blocks are added 308 to output a power RF output signal 313.

The processing module 404 also receives a set value 304 in which correction parameters chosen by the operator are defined, including particularly the correction ratio, the application frequency, the preliminary settings as a function of the category of sound program, definition of minimum/maximum RF powers limits, etc. It receives the multiplex signal 312 and a sampling 311 of the power RF output signal through a probe 309 and, depending on which additional modules are included, the processing module 404 receives the L+R audio signal 403 and/or the modulation signal M 402. The processing module performs the calculations necessary to generate a control signal 410 for the driver stages 305 and possibly the driving of the delay line 401 and/or the driving 412 of the exciter 302 or FM carrier generator and/or the driving 411 of the RF power blocks 307 and/or the driving 405 of the power blocks power supply 406.

The module 404 calculates the average RF power of the transmitter over a duration T through the signal 311 output from the measurement probe 309, and weights the control signal of module 404*c* to keep this signal within the limits defined by the set values 304 that form a control for the transmitter power.

The objective is obviously to reduce the operating cost of the transmitter or all transmitters in several networks, without any significant and audible deterioration to the sound program received at the listener, but also to maintain optimum listening comfort when the nature of the program is such that in theory, a sufficient apparent signal/noise ratio cannot be achieved in areas with difficult reception.

This management of RF power by the modulating signal makes it possible to evaluate the equivalent efficiency of a transmitter as a function of the calculated energy/power PEPM of the modulating signal, the Loudness level according to a first variant, the variation of the level as a function of the frequency of left and right primary signals according to a second variant, with or without insertion of the device and the method according to the present disclosure.

Figure 9:
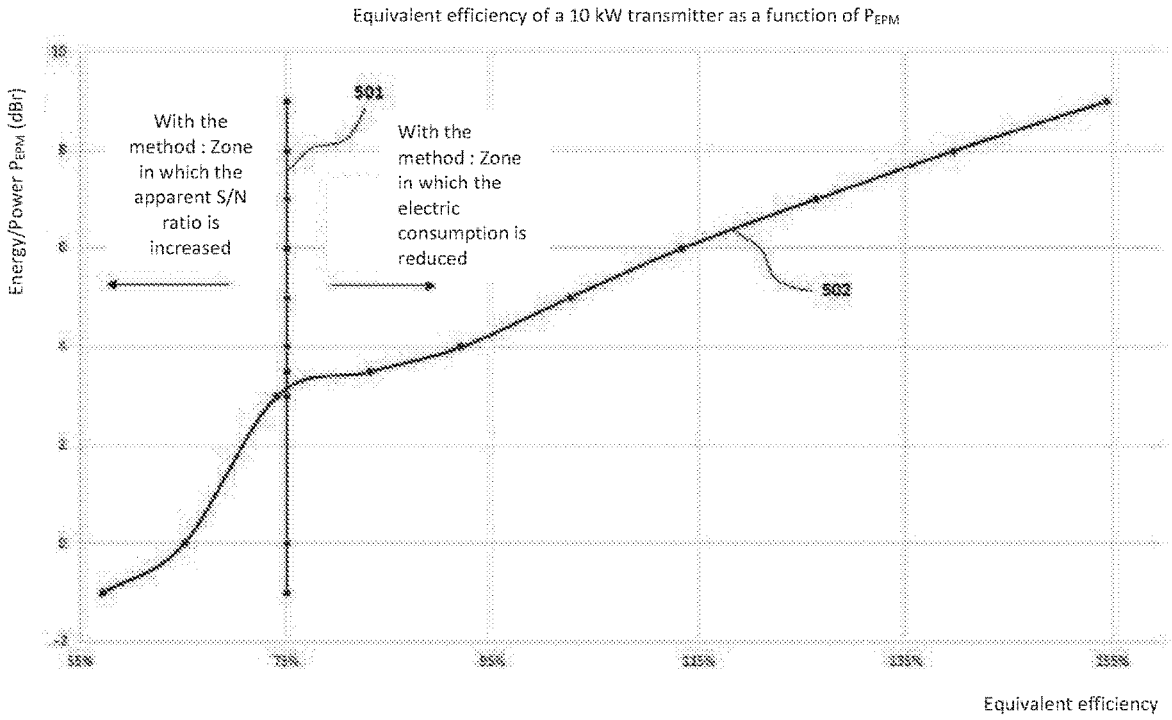
in FIGS. 9 and 10: curves illustrating the benefits of the present disclosure.
Figure 10:
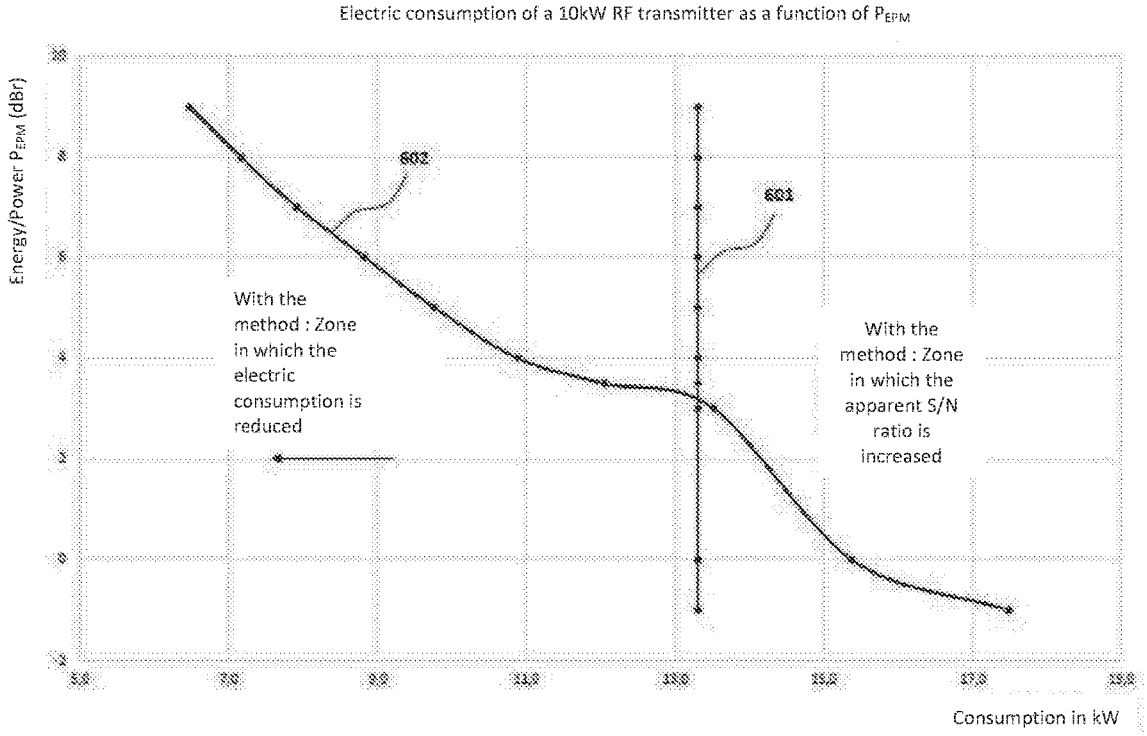

The curves in FIGS. 9 and 10 clearly show the predicted gain in efficiency and the area in which the apparent signal/noise ratio improves based on different real radio broadcasting programs:

Theoretical average equivalent efficiency of a 10 kW transmitter as a function of PEPM with curve 501, power PEPM expressed in dBr as the ordinate and with the abscissa representing the equivalent efficiency without the device according to the present disclosure and the curve 502 of power with the device according to the present disclosure;

Theoretical electricity consumption of a 10 kW RF transmitter as a function of PEPM with curve 601, transmitter consumption in kW without the device according to the present disclosure and the curve 602 of transmitter consumption in kW with the device according to the present disclosure.

With the device and method according to the present disclosure, it is thus possible to divide energy consumption by a factor of up to 2, giving an average equivalent efficiency over 24 h equal to 154% for a 10 kW transmitter.

In particular, the method according to the present disclosure allows for sampling of an electric signal indicating the real RF output power from the transmitter supplied by a measurement probe of direct and reflected output powers from the transmitter.

According to the present disclosure, the analysis of the modulating signal can take account particularly at least of signals making up the sound signal, namely firstly the left and right audio channels regardless of their level of processing, transport or coding, and secondly ancillary signals to the main sound signal; sub-carrier(s), data associated with the program, secondary programs and any form of signal contributing to the constitution of the signal modulating the transmitter, often called the Multiplex signal. The analyses made are frequency analyses on the spectrum of the modulating signal and temporal analyses with quantification of the dynamic range, the amplitude, the duration of signal presence.

The energy of the modulating signal is calculated through processing of data obtained from analyses performed on the different components of the modulating signal.

An example application is given below.

In this example, the calculation takes account of a method of the distribution of the samples of the signals and/or a direct calculation method, based on the sum of the squares of the samples. The result of these calculations is called PEPM and it is expressed in dB relative dBr with 0 dBr=neutral result requiring no variation in the RF power of the transmitter.

The calculations are derived from references and recommendations in the profession, including:

The power of the Multiplex signal as defined in ITU-R BS.412-9 and its appendices and updates;

Sound energy of the "Loudness" type with a reference to −23 LUFS defined by EBU R128 and its appendices and updates;

Depending on the results of the calculations expressed in dBr, a scale is then determined with several efficiency levels of the method as a function of the energy/power of the broadcast program. For example, the scale may include the following levels:

Level 1—A range from −3 dBr to 0 dBr designates an energy/power of the modulating signal said to be very low to low, indicating that the signal/noise ratio on reception can be optimised by increasing the RF power of the transmitter through controlling at between +1.5 dB and +0.5 dB respectively.

Level 2—A range from 0 dBr to +3 dBr designates an energy/power of the modulating signal said to be medium/low to medium, indicating that the signal/noise ratio on reception can be optimised by increasing the RF power of the transmitter through controlling at between +0.5 dB and 0 dB respectively.

Level 3—A range from +3 dBr to +6 dBr designates an energy/power of the modulating signal said to be medium/high to high, indicating that the signal/noise ratio on reception can be optimised by reducing the nominal RF power of the transmitter through controlling at between 0 dB and −2 dB respectively.

Level 4—A range from +6 dBr to +10 dBr designates an energy/power of the modulating signal said to be very high/minus to very high/plus, indicating that the signal/noise ratio on reception can be optimised by reducing the nominal RF power of the transmitter through controlling at between −2 dB and −3 dB respectively.

Level 5—A range higher than +10 dBr designates an energy/power of the modulating signal said to be very high to maximum, indicating that the signal/noise ratio on reception can be optimised by reducing the nominal RF power of the transmitter through controlling at between −3 dB and −3.5 dB respectively.

This scale is completed by a classification by categories of program obtained by the results of the spectral analysis, the frequency distribution, the sound signal modulating the transmitter and/or by the nature of associated data decoded from the RDS (Radio Data System) frame accompanying the sound program.

3 categories (A, B and C) are classified:

A/ Classic/Talkshow: modulating signal spectrum composed of transient frequencies centred essentially on medium low and medium frequencies and for which the energy by frequency/group of frequencies is low.

B/ Generalist: modulating signal spectrum alternating category A (temporal) periods and category C periods.

C/ Musical: relatively wide modulating signal spectrum from bass frequencies to treble frequencies with a low dynamic range concentrated essentially in the high part of the scale of modulator excursion levels.

The RF power controlling signal can then result in a series of algorithms and calculations to terminate a controlling curve for which the variation characteristics (typology, form) are determined as a function of energy/power ranges and programs designated categories.

Thus for example, according to one advantageous embodiment of the present disclosure applied to a program type B said to be "generalist" and for an efficiency of between levels 2 and 4, the following can be provided:

fixation of conditions for the generation of the RF power controlling signal by creating a first non-linear curve (Curve A) between the variation in the calculated signal PEPM and the RF power PRF such that for PEPM=+3 dBr there is an RF increase/attenuation of 0 dB and for PEPM=+10 dBr, there is 3 dB of RF attenuation determination of the shape of the variation:

a) weighted and inverted logarithmic type variation of RF controlling for a calculated signal PEPM between +3 dBr and +5 dBr, b) linear type variation of RF controlling for a calculated signal PEPM between +5 dBr and +7 dBr, c) weighted logarithmic type variation of RF controlling for a calculated signal PEPM between +7 dBr and +10 dBr, the resultant of these calculations forms the servoing control signal for RF output power of the transmitter.

Similar curves can be applied to other types of programs with different parameters, without going outside the framework of the present disclosure.

The present disclosure can also include extraction of the L+R (M) signal from the multiplex signal (MPX) through sampling of this signal to obtain the spectrum of the L+R signal, rectification of the two alternations and integration of this signal over a period (dl) to obtain a curve representative of the envelope of the L+R signal peaks, creation of a third curve (Curve C) of linear variation with the envelope of the L+R (M) signal;

a weighting of the RF controlling derived from curve A, using data from the third curve (Curve C) with the following conditions:

in case of a variation determined to be fast, <about 300 ms or 400 ms, of the third curve (Curve C) to 0, the RF controlling ratio is reduced.

variations in the increase of the envelope considered to be fast are ignored in weighting when the latter is less than 0.5 dB.

According to one particular alternative or complementary embodiment, the present disclosure may comprise:

carry out a fast Fourier transformation FFT on a useful signal band with the L+R (M) signal including the evaluation of the value of the average instantaneous amplitude, by frequency range and preferably by octave or ⅓ of an octave;

make a series of supplementary curves (Curves C01, C02, C03, . . . , C0n) for successive increasing frequency ranges from the FFT, calculating the envelope of the amplitude for each range as a function of a reference integration time;

quantification of the difference in energy (density) between each envelope of each curve thus formed;

creation of a weighting algorithm for the RF power controlling signal.

According to one particular embodiment applied to the example but that can include different thresholds and limits depending on the application, the algorithm is designed to give:

No weighting if the amplitude of the successive frequency ranges curves is decreasing with increasing rank of the curves;

Weighting of −5% to −25% of RF controlling if the difference in amplitude between curves of increasing frequency ranges becomes smaller;

Maximum weighting of −25% to −50% of RF controlling if the amplitude of lower rank curves is less than or equal to the amplitude of higher rank curves;

the weighted signal thus determined becoming the constituent of the transmitter power servoing control.

For simplification reasons, the curves are distributed on frequency ranges such as third octaves, octaves or pairs of consecutive octaves.

According to one particular embodiment adapted to application in the FM band, the distribution is made on 4 curves on a 20 Hz-20 kHz band or more precisely four curves per pair of octaves in the 40 Hz-10.24 kHz band assuming that the 20 Hz-40 Hz and 10 kHz-20 kHz ranges only make a small contribution to the energy of the signal.

Reusing the distribution in four curves mentioned above, weighting is adapted as a function of differences between the curves.

According to one particular embodiment and although not essential considering the masking effect, the present disclosure may include the insertion of a programmed broadcasting delay intended to compensate for the controlling signal calculation time, the calculation time of the controlling level of the RF power and rephasing of the RF power controlling signal with the broadcast sound signal.

The method according to the present disclosure advantageously comprises a series of algorithms that combine calculations derived from real time measurements and recordings of parameters such as:

general mask effect preferably calculated in the 40 Hz-15 kHz frequency band but that can be extended in the 20 Hz-20 kHz band;

signal/noise ratio based on psychoacoustic rules, calculated in the 40 Hz-15 kHz frequency band;

setup and disappearance times of masking sounds;

calculated Loudness level of the modulating sound signal;

calculated energy/power level PEPM of the modulating signal;

to obtain a resultant signal representative of the variation of the apparent signal/noise ratio perceived by the user; use of this resultant signal to control the transmitter RF power, more or less, by acting either on the RF excitation control or on controls of intermediate power stages (driver) or final power stages (power blocks), or on power supply voltages of power stages, or on a mix of two or three of these actions.

According to one embodiment of the present disclosure, the method according to the present disclosure comprises a calculation of the energy/power PEPM of the modulating signal using a method of distributing sound samples within a table of excursion levels and/or using a method of adding the squares of the values of the samples.

According to one alternative or complementary embodiment, the method includes the fixation of conditions for generation of the RF power controlling signal resulting from calculations of PEPM expressed in dBr, and determination of a correction scale as a function of the energy/power of the representative signal, said scale including the association of a series of consecutive ranges of increasing levels of the representative signal to a series of consecutive levels of decreasing corrections of the transmitter RF power by the controlling signal, scale for which for low levels the controlling increases the transmitter RF power and for high levels the controlling reduces the transmitter RF power.

The implementation device of the method according to the present disclosure may include:

means for calculating the average transmitter RF output power, possibly taking account of measurements output from the probe (309), and over a duration T defined as a set value, means for comparing results of the calculation of the average RF power with minimum/maximum power values defined as stored set limits, means for holding the average output power within set limits over a duration T, by weighting the transmitter RF power servoing control signal.

The present disclosure is not limited to the examples described and can combine several compensation methods described either to optimise the power as a function of the sound content of the program, or to maximise the transmitted power also as a function of the sound content.

What is claimed is:

1. A method for optimising the transmission power of an FM radio broadcasting transmitter, the method comprising:

sampling of a signal representative of audio content to be broadcasted by the FM radio broadcasting transmitter;

continuously calculating constitutive parameters of said representative signal among a frequency, amplitude, dynamic range, temporal distribution, energy and power;

continuously analysing said parameters in comparison with a model of psycho-acoustic data;

generating a signal controlling RF power of the transmitter as a function of the results of the analysis and the calculations made possible with said constitutive parameters and said psycho-acoustic data continuously;

controlling the RF power of the transmitter using the controlling signal.

2. Method according to claim 1 for which the representative signal is chosen among an audio signal, a Multiplex signal (MPX), a signal M (mono L+R), and a signal M (mono L+R)+S (stereo L−R).

3. Method according to claim 1 comprising a calculation of energy/power PEPM of a modulating signal using a method of distributing sound samples within a table of excursion levels and/or using a method of adding squares of values of the sound samples.

4. Method according to claim 3 comprising, for the calculation of the energy/power PEPM, one of calculating a minimum sample duration (d), calculating a total of the level of each observation after (n*d) samples, and calculating the energy/power PEPM based on sliding second principle by adding new samples with recurrence (d).

5. Method according to claim 1 comprising a fixation of conditions for generation of the RF power controlling signal resulting from calculations of PEPM, expressed in dBr, and determination of a correction scale as a function of the energy/power of the representative signal, said scale including the association of a series of consecutive ranges of increasing levels of the representative signal to a series of consecutive decreasing correction levels of the transmitter RF power by the controlling signal, scale for which for low levels of transmitter RF power the controlling increases the transmitter RF power and for high levels of transmitter RF power the controlling reduces the transmitter RF power.

6. Method according to claim 5, comprising:

fixing conditions for generation of the RF power increase controlling signal by establishing a value of energy/power PEPM of the representative signal and RF power PRF such that:

a) for PEPM equal to more than −3 dBr and less than 0 dBr, calculation of the controlling of the RF power from +1.5 dB to 0.5 dB, b) for PEPM equal to more than 0 dBr and less than +3 dBr, calculation of the controlling of the RF power from +0.5 dB to 0 dB, fixing of conditions for the generation of an RF power attenuation controlling signal by establishing a first non-linear curve (Curve A) called first curve between a variation in the power/energy PEPM of the representative signal and the RF power (PRF) such that for PEPM=+3 dBr there is 0 dB of RF increase/attenuation and for PEPM greater than or equal to 10 dBr, there is 3.5 dB of RF attenuation;

determination of a shape of the variation:

a) weighted and inverted logarithmic type variation of the controlling of the RF power for a calculated energy/power PEPM between +3 dBr and +5 dBr, b) linear type variation, of the controlling of the RF power for a calculated energy/power PEPM between +5 dBr and +7 dBr, c) weighted logarithmic type variation of the controlling of the RF power for a calculated energy/power PEPM between +7 dBr and +10 dBr, and for which the resultant of these calculations forms a servoing control signal for RF output power of the transmitter.

7. Method according to claim 6, for which the 0 dBr reference of the energy/power PEPM of the modulating signal corresponds to a permanent signal with frequency 1 kHz provoking a frequency excursion or deviation equal to ±19 kHz.

8. Method according to claim 6, for which only the range of energy/power PEPM of the modulating signal greater than −3 dBr is considered.

9. Method according to claim 6, for which the controlling of the RF power is from −3.5 dB to +1.5 dB.

10. Method according to claim 6, for which a second non-linear curve (Curve B) said second curve is established making use of Loudness calculation data using a Loudness level accepted in radio broadcasting as reference, namely −23 LUFS, with a dynamic range of the order of 20 LU and comprising the following steps:

calculating the Loudness;

determining a shape of the variation of said second curve (Curve B) as a function of the Loudness;

establishing a weighting signal of the first control curve (Curve A) of a driver stage of an amplifier and the controlling of the RF output power of the transmitter from the resultant of these calculations, with the following steps:

calculating the Loudness for a result of the measurement of the energy/power PEPM (curve A) at time T, calculating the value of the RF controlling in dB (V1) from the first curve (Curve A) and the value (V2) of weighting calculated in % according to the second curve (Curve B), calculating the weighted value (V3) of the controlling of the RF power to be provided to power stages, using the following formulation:

$$V3=V1-(V1*V2)$$

11. Method according to claim 10, for which the following rules are used in the calculation of the shape of the second curve:

a—weighted and inverted logarithmic type variation of the controlling of the RF power for a calculated loudness between −43 LU and −37 LU, b—linear type variation of the controlling of the RF power for a calculated Loudness between −37 LU and −30 LU, c—weighted logarithmic type variation of the controlling of the RF power for a calculated Loudness between −30 LU and −23 LU.

12. Method according to claim 6, comprising extraction of an L+R (M) signal from a multiplex signal, sampling of the L+R (M) signal to obtain the spectrum of the L+R signal, rectification of two alternations and integration of the L+R (M) signal over a period (dl) to obtain a curve representative of an envelope of L+R signal peaks, establishment of a curve (Curve C) called the third curve of linear variation with the envelope of the L+R (M) signal; and weighting of the controlling of the RF power obtained from the first curve (curve A) using data from the third curve (Curve C) with the following conditions:

in case of a variation determined to be fast or less than about 300 ms, of the third curve (Curve C) towards 0, the RF power control ratio is reduced;

variations of the increase of the envelope determined to be fast are ignored in weighting when the latter is less than 0.5 dB.

13. Method according to claim 1 comprising a creation of a classification by categories of a sound program obtained by results of a spectral analysis of a sound signal modulating the transmitter and/or by nature of associated data decoded from an Radio Data System (RDS) frame accompanying the sound program and application of an RF power correction based on category type.

14. Method according to claim 1 comprising:

carrying out a fast Fourier transformation FFT on a useful signal band with an L+R (M) signal including evaluation of a value of an average instantaneous amplitude, by frequency range;

establishing a series of curves called supplementary curves (Curves C01, C02, C03, . . . , C0n) for successive increasing frequency ranges from the FFT, calculating the envelope amplitude for each range as a function of a reference integration time;

quantification of the difference in energy or energy density between each envelope of each curve thus formed;

creation of a weighting algorithm for the RF power controlling.

15. Method according to claim 14, for which the weighting algorithm is produced using the following rules:

no weighting if the amplitude of the successive frequency ranges curves is decreasing with increasing rank of the curves;

weighting of −5% to −25% of the controlling of the RF power if the difference in amplitude between the curves of increasing frequency ranges becomes smaller;

maximum weighting of −25% to −50% of the controlling of the RF power if the amplitude of lower rank curves is less than or equal to the amplitude of higher rank curves;

the weighted signal thus determined becoming a constituent of servoing control of transmitter power stages.

16. Method according to claim 14, for which the supplementary curves are made on frequency bands containing consecutive third octaves or octaves, integration time for the calculation of the amplitude envelope being greater than or equal to the inverse of a lowest frequency in a frequency band for each curve.

17. Method according to claim 16, comprising the following distribution:

A curve C01 for the sum of the 40 Hz-80 Hz+80 Hz-160 Hz, or 20 Hz-40 Hz+40 Hz-80 Hz octaves depending on a type of program, with an integration time greater than or equal to 1/F01, where F01 is the lowest frequency in the frequency range used for this curve;

A curve C02 for the sum of the next two octaves, the 160 Hz-320 Hz+320 Hz-640 Hz, or 80 Hz-160 Hz+160 Hz-320 Hz octaves if the first curve is shifted downwards, with an integration time greater than or equal to 1/F02, where F02 is the lowest frequency in the frequency range used for this curve;

A curve C03 for the sum of the 640 Hz-1.28 kHz+1.28 kHz-2.56 kHz, or 320 Hz-640 Hz+640 Hz-1.28 kHz octaves for a lower curve shifted downwards, with an integration time greater than or equal to 1/F03, where F03 is the lowest frequency in the frequency range used for this curve;

A curve C04 if necessary for the sum of the 2.56 kHz-5.12 kHz+5.12 kHz-10.24 kHz, or 1.28 kHz-2.56 kHz+2.56 kHz-5.12 kHz+5.12 kHz-10.24 kHz octaves for a lower curve shifted downwards, with an integration time greater than or equal to 1/F04, where F04 is the lowest frequency in the frequency range used for this curve.

18. Method according to claim 14 for which with four curves (C01, C02, C03, C04) distributed on the 20 Hz-20 kHz or 40 Hz-10.24 kHz useful spectrum:

no weighting is made if the amplitude of curve C01 is 6 dB higher than curve C02, itself 4 dB higher than curve C03, itself 2 dB higher than curve C04, a maximum weighting is made equal to −25% of the controlling of the RF power if the total differences between C01 and C04 are not more than 6 dB;

a maximum weighting of −50% of the controlling of the RF power is made if the difference in amplitude between curves C01 and C04 shows that the amplitude (C01+C02) is less than or equal to the amplitude (C03+C04).

19. Method according to claim 1 comprising the insertion of a programmed broadcasting delay intended to compensate for a controlling signal calculation time, a calculation of the control level of the RF power adapted to vary the power adjustment control before observation of a variation in a density of a delayed modulating signal and a phase synchronization of a signal controlling an RF signal with a broadcasted sound signal.

* * * * *